US005676178A

United States Patent [19]

Ehnimb

[11] Patent Number: 5,676,178

[45] Date of Patent: Oct. 14, 1997

[54] LASHING STRAP WITH WEBBING HAVING A TAPERED END LOOP REGION

[75] Inventor: David Ehnimb, Oetwil am See, Switzerland

[73] Assignee: Spanset Inter AG, Oetwil am See, Switzerland

[21] Appl. No.: 519,164

[22] Filed: Aug. 25, 1995

[30] Foreign Application Priority Data

Jul. 3, 1995 [DE] Germany ..... 295 11 240.9
Aug. 24, 1995 [DE] Germany ..... 295 14 175.1

[51] Int. Cl.[6] ..... D03D 1/00

[52] U.S. Cl. ..... 139/384 R; 24/302

[58] Field of Search ..... 139/384 R; 24/302; 224/901.4; 248/499

[56] References Cited

U.S. PATENT DOCUMENTS

| | | | |
|---|---|---|---|
| 694,108 | 2/1902 | Nierhaus et al. | 139/384 R |
| 1,095,740 | 5/1914 | Seidman | 139/384 R |
| 2,301,261 | 11/1942 | Diehl et al. | 139/384 R |
| 5,511,702 | 4/1996 | Yang | 224/901.4 X |

*Primary Examiner*—Andy Falik
*Attorney, Agent, or Firm*—Spencer & Frank

[57] ABSTRACT

A lashing strap comprises a webbing including warp threads extending in a warp direction and spaced with respect to one another in a direction transverse to the warp direction thereby defining warp spacings therebetween. The lashing strap further has an end loop region at one end thereof and a strap region adjacent the end loop region, the warp spacings in the end loop region being less than the warp spacings in the strap region such that the lashing strap tapers from the strap region to the end loop region.

8 Claims, 2 Drawing Sheets

LASHING STRAP WITH WEBBING HAVING A TAPERED END LOOP REGION

FIELD OF THE INVENTION

The invention relates to textile lashing straps.

BACKGROUND OF THE INVENTION

According to the state of the art, for these straps it is conventional to fold the strap material which forms the lashing strap, either once or on both sides, in the warp direction in order to achieve a halving of the strap width. The strap halving is made permanent in that the two strap halves lying one on top of the other are stitched together by means of an edge stitch. Thereafter, these end regions, which taper in width, serve to form a loop which is drawn through a loop receptacle or fastening slot on a sheet metal hook. The end region is stitched to the rest of the strap by means of a boxed-x stitch for permanent adaptation or fastening of the hook to the lashing strap.

A disadvantage of producing this loop according to the state of the art is the necessity of the one-time folding around of the strap material in the warp direction, which at this time can only be performed manually. A further disadvantage is the non-uniform transition from the central region or strap region to the tapering end loop region and the hem edge which inevitably forms as a consequence. The strap material is especially at risk of being damaged in the region of the hem edge. Therefore, it is the object of the invention to be able to provide an end loop region on lashing straps without having to fold the strap material and stitch the edge down.

The solution to the object is achieved by the provision of a lashing strap where the warp spacings (that is the spacing of the warp threads with respect to one another in a direction transverse to the warp direction) in the end loop region is less than the warp spacings in the strap region of the lashing strap such that the lashing strap tapers from the strap region to the loop region.

The invention also pertains to a method of fastening the lashing strap to a hook. The method involves pulling the end loop region of the lashing strap through a fastening slot of the hook; folding the end loop region of the lashing strap back toward the strap region thereby forming a loop; and stitching end regions of the loop together for permanently fastening the hook to the lashing strap.

According to one aspect of the invention, the spacing of the warp threads of the webbing decreases continuously toward the end loop regions during the weaving process. The reduction of the warp thread spacing simultaneously causes a reduction in the width of the strap. This reduction in the strap width simultaneously effects the tapering loop width.

An advantage of the invention is that the end loop regions can be configured to be arbitrarily narrow. A further, significant advantage with regard to both technical performance and technical reliability is the uniform flow of force via the force-conducting warp threads in the transition region to the end loop region from the remaining strap region. The bearing and clamping capability of the strap material used is thus better utilized than in the state of the art, which significantly increases the performance reliability. The soft-flexible strap course created with the invention therefore effects better utilization of the substance of the woven strap material. Finally, the fastening seam for the band folding in the end loop region is eliminated, so that the end loop region cannot even be destroyed by the wear of the fastening seam. In terms of manufacture, the option of using numerically-controlled weaving machines that need only to reduce the warp thread spacing in order to produce the loop region is advantageous.

With regard to force distribution, a warp thread distance which decreases continuously is particularly advantageous.

According to another aspect of the invention, a lashing strap can be provided having two end loop regions at the two lashing strap ends.

BRIEF DESCRIPTION OF THE DRAWINGS

A lashing strap end having a permanently-adapted hook is explained in conjunction with the drawing figures. Shown are in.

DETAILED DESCRIPTION OF THE INVENTION

Figure 1:
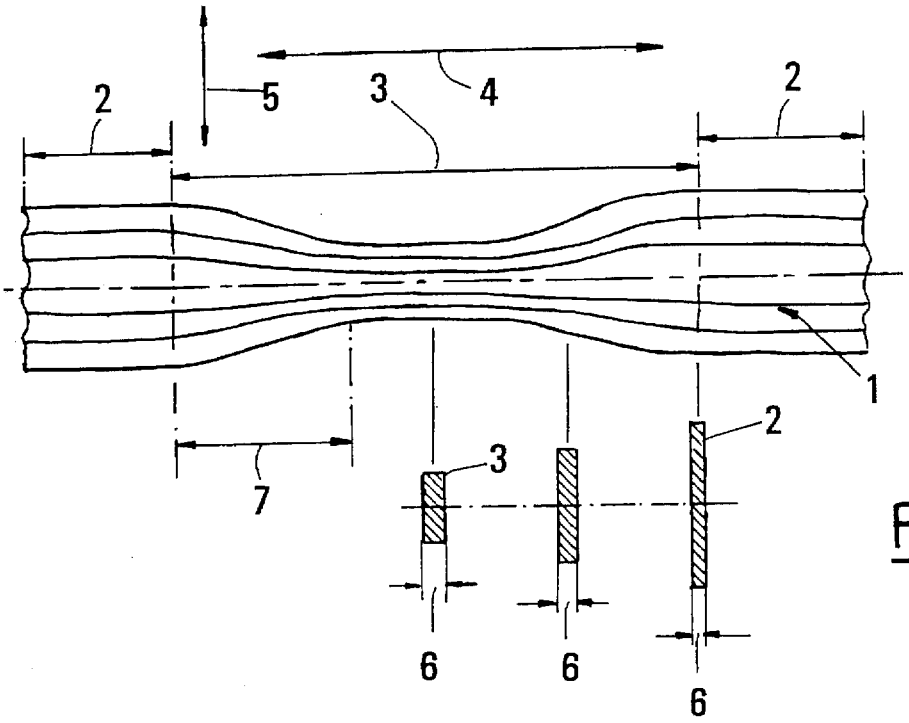
FIG. 1 the strap end region having a tapering loop region.

As shown in FIG. 1, the strap 1 includes the strap regions 2 and the end loop region 3. In the end loop region 3, the spacings of the warp threads or warp spacings, which are shown schematically in the drawings and extend in the warp direction 4, are smaller than in the strap regions 2 when measured in the woof direction 5. This reduction in the warp thread spacing when measured in the woof direction 5 causes a tapering width of the strap 1 in the end loop region 3. In FIG. 1, three different band thicknesses 6 are indicated beneath the illustrated strap 1. It can be seen from this figure that the strap thickness 6 in the end loop region 3 is much higher than in the strap region 2. In addition, it is indicated that the strap thickness 6 in the transition region 7 between the strap region 2 and the area of the end loop region 3, with the smallest width when measured in the woof direction, is already higher than in strap region 2.

Figure 2:
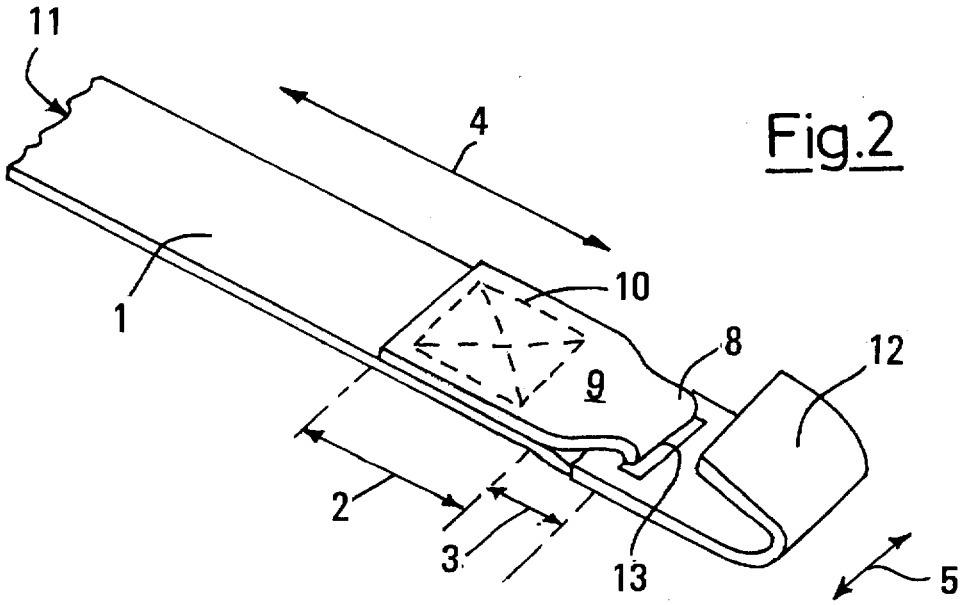
FIG. 2 a lashing strap end region having a permanently-attached hook.
Figure 3:
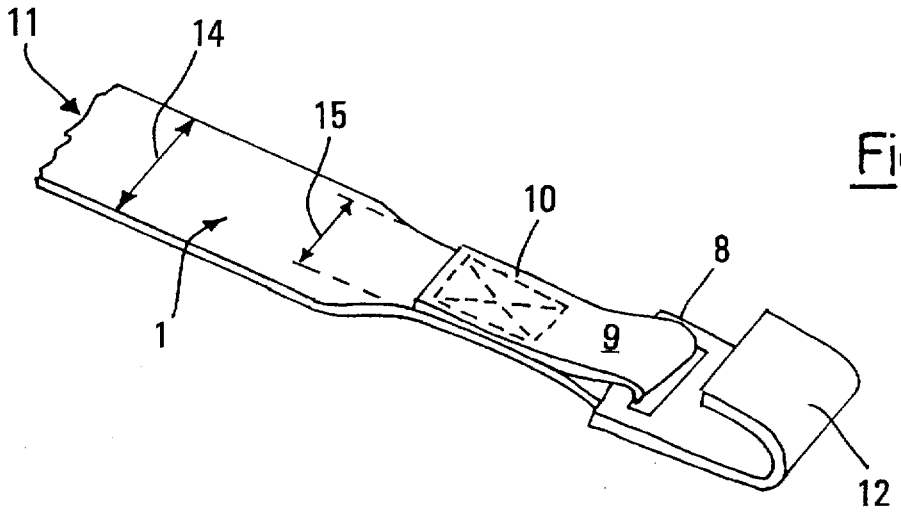
FIG. 3 a modified version of the embodiment of FIG. 2.

To form the loop 8, the strap end 9, corresponding to the end loop region, is folded back toward the remaining strap region 2 in the warp direction 4 to such an extent that the strap 1 is folded in the woof direction 5, as shown in FIGS. 2 and 3. The folded-back lashing strap end is then stitched to the remainder of the strap 1 by means of a boxed-x stitch 10 in order to form the loop 8 (FIG. 2).

In the lashing strap 11, with respect to the strap region 2, the strap material is reduced in its inherent width extending in the woof direction 5 in the end loop region 3. The reduction of the inherent width in the region of the loop 8 is again effected by a reduction of the warp thread spacing when measured in the woof direction 5. Prior to the stitching of the loop 8 by means of the boxed-x stitch 10, the hook 12 is additionally attached to the lashing strap 11 in that the lashing strap end is pulled through a fastening slot 13 on the hook 12, drawn back in warp direction 4 and only then stitched to the remaining strap 1 by means of the boxed-x stitch 10.

In the special embodiment shown in FIG. 3, not only is the end loop region 3 tapered; the entire strap end 9 is tapered as well. With the lashing strap end width 15 being reduced with respect to the lashing strap width 14, the length of the boxed-x stitch 10 and thus the sewing expenditure needed for its production are reduced.

Figure 4:
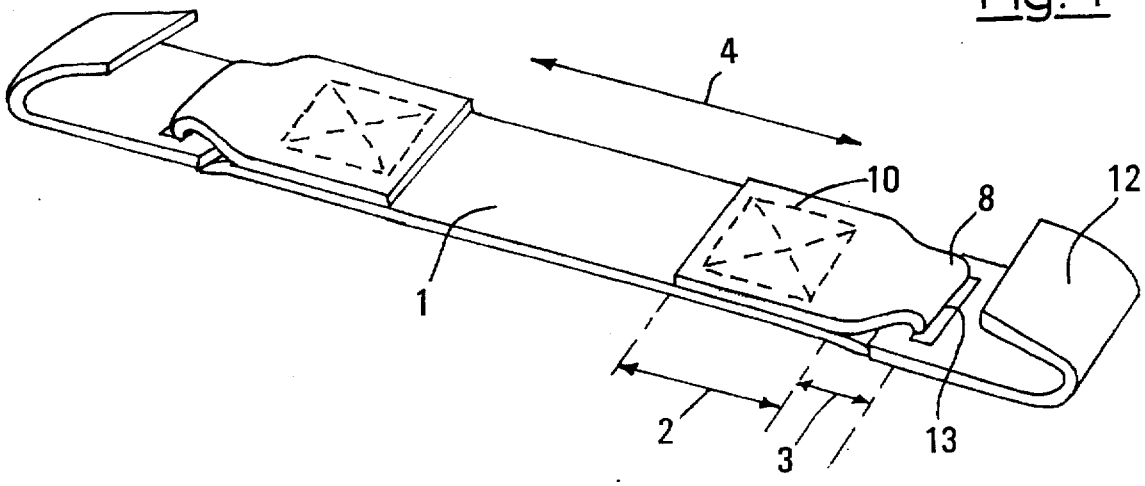
FIG. 4 the lashing strap of FIG. 2 having two end loop regions.

FIG. 4 shows the lashing strap of FIG. 2 having two end loop regions.

What is claimed is:

1. A lashing strap adapted to transmit force and comprising a webbing including warp threads extending in a warp direction and spaced with respect to one another in a direction transverse to the warp direction thereby defining warp spacings therebetween, the lashing strap further having an end loop region at one end thereof and a strap region adjacent the end loop region, the warp spacings in the end loop region being less than the warp spacings in the strap region such that the lashing strap tapers from the strap region to the end loop region.

2. The lashing strap according to claim 1, wherein the warp spacings decrease continuously from the strap region to the end loop region thereby defining a transition region of the lashing strap.

3. The lashing strap according to claim 2, wherein the end loop region is a first end loop region, the lashing strap further comprising a second end loop region at another end thereof, the second end loop region being configured similarly to the first end loop region.

4. The lashing strap according to claim 1, wherein the end loop region is a first end loop region, the lashing strap further comprising a second end loop region at another end thereof, the second end loop region being configured similarly to the first end loop region.

5. The lashing strap according to claim 5, wherein the lashing strap has a thickness which decreases from the strap region to the end loop region.

6. A method of fastening the lashing strap according to claim 1 to a hook having a fastening slot, comprising the steps of:

pulling the end loop region of the lashing strap through the fastening slot of the hook;

folding the end loop region of the lashing strap back toward the strap region thereby forming a loop; and stitching end regions of the loop together for permanently fastening the hook to the lashing strap.

7. The method according to claim 6, wherein the step of stitching includes the step of sewing a boxed-x stitch.

8. The method according to claim 6, wherein the step of folding comprises the step of folding the end loop region on itself, such that all of the loop corresponds to the end loop region.

* * * * *